United States Patent [19]

Kojo et al.

[11] 4,172,338

[45] Oct. 30, 1979

[54] APPARATUS FOR GRINDING OR POLISHING ARTICLE HAVING CYLINDRICAL OR CURVED SURFACE

[75] Inventors: Ichiro Kojo, Ichikawa; Kiyomi Yamaguchi, Funabashi; Tiuzi Fumikura, Ichikawa, all of Japan

[73] Assignee: Asahi Glass Company, Ltd., Tokyo, Japan

[21] Appl. No.: 870,498

[22] Filed: Jan. 18, 1978

[51] Int. Cl.[2] ..... B24B 5/00

[52] U.S. Cl. ..... 51/97 R; 51/124 L; 51/237 R

[58] Field of Search ..... 51/46, 97 R, 97 NC, 51/100 R, 101 R, 124 R, 124 L, 131 R, 163.1, 234, 237 R, 33 W; 269/321 T

[56] References Cited

U.S. PATENT DOCUMENTS

| | | | |
|---|---|---|---|
| 2,826,870 | 3/1958 | Soubier | 269/321 T |
| 3,390,490 | 7/1968 | Hesslenberg | 51/163.1 |
| 3,838,540 | 10/1974 | Steinmetz | 51/124 R X |
| 4,033,231 | 7/1977 | Goloff | 51/101 |

*Primary Examiner*—Harold D. Whitehead
*Assistant Examiner*—Robert P. Olszewski
*Attorney, Agent, or Firm*—Oblon, Fisher, Spivak, McClelland & Maier

[57] ABSTRACT

An apparatus for grinding or polishing an article having a cylindrical curved surface comprises a turn table attached at an end of a rotary shaft by a pin joint and turned to a predetermined direction by the rotary shaft; a grinding means for grinding or polishing the article set on the turn table; a cam provided around the rotary shaft of the turn table; a cam roller contacting the cam; whereby the turn table is rocked around the pin joint by the cam and the cam roller; and the curved surface of the article is uniformly ground or polished by setting the article on the turn table so as to substantially arrange the cylindrical axis direction Y—Y of the article in the pin joint direction.

5 Claims, 4 Drawing Figures

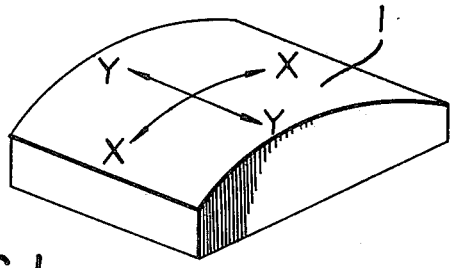
FIG. 1
FIG. 3
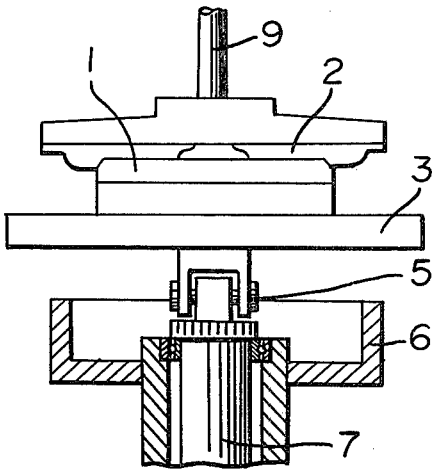
FIG. 2
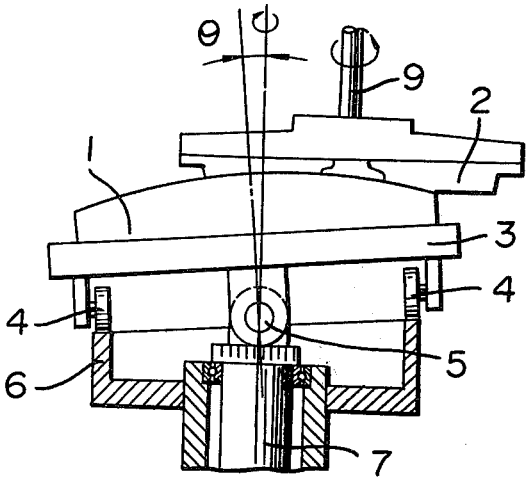
FIG. 4
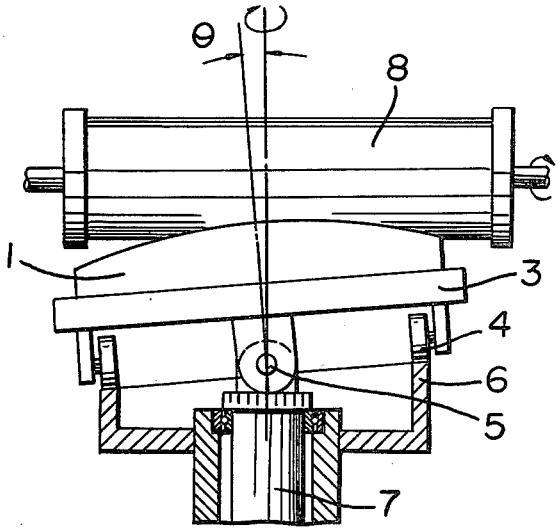

APPARATUS FOR GRINDING OR POLISHING ARTICLE HAVING CYLINDRICAL OR CURVED SURFACE

BACKGROUND OF THE INVENTION

Field of the Invention

The present invention relates to an apparatus for grinding and polishing an article having a cylindrical curved surface.

Heretofore, it has been known to use a as grinder for grinding an article having a curved surface, such as a face surface or a panel of a cathode ray tube, a grinder having a rotary hollow drum and a grinder having a concave grinding surface whose curvature is substantially equal to the curvature of the article (Japanese Utility Model Publication No. 18288/1960 and Japanese Patent Publication No. 28753/1965). These grinders can be easily used for grinding a spherical surface however, it is difficult to grind a non-spherical curved surface such as a cylindrical curved surface by these grinders, especially the latter grinder.

SUMMARY OF THE INVENTION

It is an object of the present invention to overcome these disadvantages of the conventional grinders and to provide an apparatus for uniformly grinding or polishing an article having a cylindrical curved surface.

The foregoing and other objects of the present invention have been attained by providing an apparatus for grinding or polishing an article having a cylindrical curved surface which comprises a turn table attached at an end of a rotary shaft by a pin joint and turned to a predetermined direction by the rotary shaft; a grinding means for grinding or polishing an article set on the turn table; a cam provided around the rotary shaft of the turn table; a cam roller contacting the cam; whereby the turn table is rocked around the pin joint by the cam and the cam roller; and the curved surface of the article is uniformly ground or polished by setting the article on the turn table so as to substantially arrange the cylindrical axis direction Y—Y of the article in the pin joint direction.

BRIEF DESCRIPTION OF THE DRAWINGS

FIG. 1 is a schematic view of a panel of a television receiver which has a cylindrical curved surface;

FIG. 2 is a sectional view of one embodiment of the apparatus of the present invention at the slant position of the turn table;

FIG. 3 is a sectional view of the embodiment of the apparatus of the present invention at the perpendicular direction to FIG. 2; and FIG. 4 is a sectional view of the other embodiment of the apparatus of the present invention.

DETAILED DESCRIPTION OF THE PREFERRED EMBODIMENT

Referring to the drawings, certain embodiments of the present invention will be described in detail.

The apparatus of the present invention can be used for grinding and polishing an article by selecting an abrasive.

FIG. 1 shows a panel of a cathode ray tube which has a cylindrical curved surface. The face surface of the panel being ground has the circumferential direction X—X having curvature and the cylindrical axis direction Y—Y having no curvature.

FIGS. 2 and 3 show one embodiment of the apparatus of the present invention which grinds or polishes a panel (1). The face surface of the panel (1) having a cylindrical curved surface shape.

As is clear from FIGS. 2 and 3, a turn table (3) for supporting the panel (1) being ground or polished, is attached by a pin joint (5) at the end of a rotary shaft (7) and a cam (6) is provided around the rotary shaft and cam rollers (4) are connected to the turn table (3) whereby the cam rollers (4) are fitted to the cam (6) when the turn table (3) is turned by the rotary shaft (7). In this case, the cam rollers (4) are connected to the turn table (3) only in the direction perpendicular to the pin joint (5) whereas no cam roller is connected in the direction of the pin joint (5).

The turn table (3) is attached to the rotary shaft (7) by the pin joint (5) whereby the turn table (3) can be rocked around the pin joint (5) and inclined at a suitable slant in the direction perpendicular to the pin joint (5) without, however, inclining it in the direction of the pin joint (5) because the turn table is held by the pin joint.

On the other hand, the cam (6) is provided in an annulus around the rotary shaft (7). The cam surface formed on the cylindrical body is usually a continuous slanted suface. That is, the heights of the cam surface of the cam (6) at both sides of a rotary shaft (7) in the specific direction are different.

FIG. 2 shows a sectional view of a apparatus in a direction having different heights of the cam surface.

FIG. 3 shows the sectional view of the same apparatus in the perpendicular direction having substantially the same heights of the cam surface at the both sides of the rotary shaft (7). When the turn table (3) is rocked by the rotary shaft (7), the turn table (3) is turned under the guidance of the cam (6) through the cam rollers (4) whereby the turn table is turned and rocked corresponding to the slant cam surface of the cam (6).

Referring to the drawings, the turning and rocking of the turn table (3) is described in detail. The cam rollers (4) are connected in a direction so as to rock the turn table (3) around the pin joint (5) that is, the direction perpendicular to the pin joint (5). Accordingly, when the cam rollers (4) move to the position resulting different height of the cam surface of the cam (6) shown in FIG. 2, the turn table (3) is slanted of the angle $\theta$ decided by the height difference. When the cam rollers (4) further move, the slant angle is reduced. When the turn table (3) is turned for 90 degree from the state shown in FIG. 2, the cam surface of the cam (6) have substantially the same height at both sides of rotary shaft whereby the turn table (3) is held in horizontal direction without any slant. In this case, the turn table (3) is not slant to the direction of the pin joint (5) regardless of the slant of the cam surface of the cam (6).

FIG. 3 shows the sectional view of the apparatus in the direction of the pin joint (5).

The slant angle $\theta$ of the turn table (3) can be decided by the shape of the cam surface of the cam (6) and the slant angle is selected depending upon the curvature of the curved surface of the article being ground or polished. When the curvature is larger, the slant angle $\theta$ is usually increased.

On the other hand, the grinding means (2) is eccentrically disposed to the rotary shaft of the turn table (3) so as to reduce unevenness in the grinding or polishing. The grinding means (2) is rotated around the shaft (9) to grind or polish the face surface of the panel (1) set on the turn table (3).

When the grinding means having the specific grinding surface shown in FIGS. 2 and 3 is used, the effect of the present invention is especially remarkable.

Thus, a rotary hollow drum 8 shown in FIG. 4 can be also used as the grinding means.

When the article having the cylindrical curved surface is ground or polished by the present invention, it is important to arrange the cylindrical axis direction Y—Y of the curved surface to the direction of the pin joint of the turn table (3). When the article is set on the turn table in said direction, the surface of the article can be uniformly contacted with the grinding means by rocking the turn table by the cam mechanism whereby the grinding and polishing can be uniformly attained.

Certain embodiments of the apparatus of the present invention have been described. The cam can be modified in the scope of the invention for the purpose of said movement to rock the turn table (3) under the specific condition with respect to the rotary shaft.

For example, in said embodiments, a fixed cam is disclosed, however it is possible to vertically move the cam surface in synchronization with the rotary period of the turn table (3) whereby the turn table is rocked while inclining in the specific direction.

In the latter case, it is suitable to connect the cam rollers at the top of the cam which is vertically moved, and to contact the cam rollers to the turn table.

In said embodiments, the cam mechanism is provided under the turn table. Thus, it is possible to form the cam mechanism around the turn table. It is usual to provide the cam mechanism around the rotary shaft. However, in the case of the vertical movable cam, it is possible to provide the cam mechanism only at a specific position around the rotary shaft. In the present invention, the term of around a rotary shaft include said features.

In accordance with the present invention, the article having a cylindrical curved surface or the similar surface can be uniformly ground or polished by the conventional grinding means though it has not been easily attained by the conventional apparatuses.

What is claimed is:

1. An apparatus for grinding or polishing an article having a cylindrical curved surface, said apparatus comprising:

a turntable for supporting said article;

a rotary shaft;

a pin joint connecting said turntable with said rotary shaft and permitting rocking of said turntable about the axis of said pin joint, and pin joint being located adjacent to the side of said turntable opposite the side supporting said article;

an annular cam, having a cam surface that causes said turntable to rock about said joint axis, provided about said rotary shaft, and a cam roller contacting said cam surface; and a grinding means for grinding and polishing said article.

2. An apparatus according to claim 1 wherein the cam rollers are connected to the turn table in the direction perpendicular to the pin joint direction.

3. An apparatus according to claim 1 wherein the article is a panel of a cathode ray tube of a television receiver.

4. An apparatus according to claim 1 wherein the grinding means is eccentrically disposed to the rotary shaft of the turn table.

5. The apparatus of claim 1 wherein said cam surface defines a plane which passes through said pin joint.

* * * * *